US012065229B1

(12) United States Patent
Groeschel

(10) Patent No.: US 12,065,229 B1
(45) Date of Patent: Aug. 20, 2024

(54) MULTI-FUNCTIONAL TRANSOM SAVER FOR SUPPORTING AN OUTBOARD MOTOR

(71) Applicant: Brunswick Corporation, Mettawa, IL (US)

(72) Inventor: John A. Groeschel, Theresa, WI (US)

(73) Assignee: Brunswick Corporation, Mettawa, IL (US)

( * ) Notice: Subject to any disclaimer, the term of this patent is extended or adjusted under 35 U.S.C. 154(b) by 419 days.

(21) Appl. No.: 17/496,177

(22) Filed: Oct. 7, 2021

(51) Int. Cl.
*B63H 20/04* (2006.01)
*B63H 20/10* (2006.01)

(52) U.S. Cl.
CPC ..... *B63H 20/04* (2013.01); *B63H 20/10* (2013.01); *B63H 2020/103* (2013.01)

(58) Field of Classification Search
CPC ..... B63H 20/00; B63H 20/02; B63H 20/04; B63H 20/06; B63H 20/08; B63H 20/10; B63H 2020/103
USPC ..... 440/53, 55, 62
See application file for complete search history.

(56) References Cited

U.S. PATENT DOCUMENTS

| | | | | |
|---|---|---|---|---|
| 2,901,267 | A | 8/1959 | Holsclaw | |
| 3,941,344 | A | 3/1976 | Paterson | |
| 4,125,236 | A | 11/1978 | Landwerlen | |
| 4,331,431 | A | 5/1982 | Estes | |
| 4,650,427 | A * | 3/1987 | Huchinson | B63H 20/36 248/351 |
| D289,296 | S | 4/1987 | Mahoney | |
| 4,828,186 | A | 5/1989 | Weiss | |
| 4,842,239 | A | 6/1989 | Kinsey et al. | |
| 4,911,395 | A | 3/1990 | Jones, Jr. | |
| 4,929,202 | A | 5/1990 | Tengelitsch | |
| 5,031,842 | A | 7/1991 | Mohr | |
| 5,795,202 | A | 8/1998 | Williams | |
| D420,641 | S | 2/2000 | Forthmann | |
| 6,447,350 | B2 | 9/2002 | Thompson et al. | |
| 6,494,431 | B1 | 12/2002 | McCoy | |
| 6,513,782 | B2 | 2/2003 | Fischer | |
| D533,877 | S | 12/2006 | Nakamura et al. | |
| 7,278,893 | B1 | 10/2007 | Frantz | |
| 7,311,571 | B1 | 12/2007 | Swan et al. | |
| 7,556,545 | B2 | 7/2009 | Draghici | |
| 8,096,521 | B1 | 1/2012 | Smith | |
| 8,833,725 | B1 | 9/2014 | Anderson et al. | |
| 9,145,194 | B2 | 9/2015 | Marks et al. | |
| D810,138 | S | 2/2018 | Yasinski | |
| 10,208,513 | B2 * | 2/2019 | Crawford | B63G 13/00 |
| 10,981,637 | B1 | 4/2021 | Alby et al. | |
| 11,225,312 | B2 * | 1/2022 | Wheelock | B63H 20/06 |
| 11,506,117 | B2 * | 11/2022 | Frey | B63H 20/06 |
| 2006/0035757 | A1 | 2/2006 | Flick et al. | |

(Continued)

OTHER PUBLICATIONS

Inventor's Declaration of Prior Art Signed May 8, 2024.

*Primary Examiner* — Daniel V Venne
(74) *Attorney, Agent, or Firm* — Andrus Intellectual Property Law, LLP

(57) ABSTRACT

A transom saver is for supporting an outboard motor in a trim position relative to a marine vessel. The transom saver has a body that extends between a first end and a second end. The body has a first seat and a second seat that are spaced apart and configured to support a transom bracket in a first position of use. A spring is disposed on the second side and configured to resiliently support the first swivel bracket in the first position of use.

20 Claims, 10 Drawing Sheets

(56) References Cited

U.S. PATENT DOCUMENTS

| | | | |
|---|---|---|---|
| 2007/0214852 | A1 | 9/2007 | Frantz |
| 2008/0029683 | A1 | 2/2008 | Draghici |
| 2008/0169404 | A1 | 7/2008 | Smith |
| 2009/0170384 | A1 | 7/2009 | Balogh et al. |

* cited by examiner

MULTI-FUNCTIONAL TRANSOM SAVER FOR SUPPORTING AN OUTBOARD MOTOR

FIELD

The present disclosure relates to marine drives and apparatuses for supporting marine drives with respect to marine vessels.

BACKGROUND

The following U.S. Patents are incorporated herein by reference:

U.S. Pat. No. 6,494,431 discloses a support bracket for an outboard motor in which a support arm is pivotally attached to a transom bracket of an outboard motor to allow it to pivot upward and be captured by a latching device which is rigidly attached either to a support structure, of the outboard motor or directly to its driveshaft housing. When captured within the latching device attached to the outboard motor, the support arm prevents upward or downward movement of the outboard motor and inhibits any rotation of the outboard motor about its tilt axis. The support arm also inhibits rotation of the outboard motor about its steering axis. The support mechanism therefore prevents potential damage to the outboard motor and its support brackets when the outboard motor is stored in an upwardly tilted position and subjected to shock loads.

U.S. Pat. No. 7,311,571 provides a support device for a marine propulsion system, such as an outboard motor, having a swivel bracket that is rotatable about a tilt axis relative to a transom bracket with a hydraulic cylinder formed as an integral part of the swivel bracket. A vertical plane in which a central axis of the hydraulic cylinder is disposed is positioned between and parallel to vertical planes in which the tilt axis and steering axis are disposed, respectively. The steering axis is rotatable about the tilt axis and a horizontal plane in which the central axis is disposed remains above a horizontal plane in which the tilt axis is disposed.

U.S. Pat. No. 7,556,545 discloses an outboard motor support having a trailer mount attachable to a trailer. A first arm extends from the trailer mount, and a second arm extends from an outboard motor and includes an outboard motor mount. The outboard motor support includes an adjustable coupling connecting the first arm and the second arm.

U.S. Pat. No. 10,981,637 discloses an apparatus for supporting an outboard motor on a transom of a marine vessel. The apparatus has a transom bracket configured for fixed attachment to the transom; a supporting cradle that supports the outboard motor with respect to the transom bracket, wherein the supporting cradle is pivotable with respect to the transom bracket about a trim axis; and a trim actuator that is pivotally coupled to the transom bracket at a first trim actuator pivot axis and to the supporting cradle at a second trim actuator pivot axis. Extension of the trim actuator pivots the supporting cradle upwardly about the trim axis. Retraction of the trim actuator pivots the supporting cradle downwardly about the trim axis. The trim axis is located aftwardly of the first trim actuator pivot axis.

U.S. Pat. No. 10,981,637 discloses an apparatus for supporting an outboard motor on a transom of a marine vessel. The apparatus has a transom bracket configured for fixed attachment to the transom; a supporting cradle that supports the outboard motor with respect to the transom bracket, wherein the supporting cradle is pivotable with respect to the transom bracket about a trim axis; and a trim actuator that is pivotally coupled to the transom bracket at a first trim actuator pivot axis and to the supporting cradle at a second trim actuator pivot axis. Extension of the trim actuator pivots the supporting cradle upwardly about the trim axis. Retraction of the trim actuator pivots the supporting cradle downwardly about the trim axis. The trim axis is located aftwardly of the first trim actuator pivot axis.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

A transom saver is for supporting an outboard motor in a trim position relative to a marine vessel, the outboard motor being pivotably coupled to the marine vessel by a transom bracket assembly comprising a transom bracket fixed to the marine vessel and a swivel bracket fixed to the outboard motor and being pivotable relative to the transom bracket. The transom saver comprises a body that extends between a first end and a second end in a width direction, between a first side and a second side in a height direction that is perpendicular to the width direction, and between a front side and a back side in a depth direction that is perpendicular to the width direction and perpendicular to the height direction. The body comprises a first seat and a second seat, the first seat and the second seat being spaced apart along the first side in the width direction and being configured to support the transom bracket in a position of use. At least one spring is disposed on the second side and being configured to resiliently support the swivel bracket in the position of use.

In certain examples disclosed herein the transom saver is further configured for use with both a first transom bracket assembly and a different, second transom bracket assembly. In such examples the body further comprises a third seat and a fourth seat, the third seat and the fourth seat being spaced apart along the second side and configured to support the second transom bracket in a second position of use, and a second spring disposed on the first side and being configured to resiliently support the second swivel bracket in the second position of use.

BRIEF DESCRIPTION OF THE DRAWINGS

The present disclosure is described with reference to the following Figures.

DETAILED DESCRIPTION

During research and development, the present inventor determined it would be desirable to provide multi-functional transom saver embodiments for supporting the outboard motor in a trim position relative to a marine vessel, for example during trailering and road transport of the outboard motor together with the marine vessel. The present inventor determined it would be desirable to configure embodiments of the transom saver in such a way that it can function alternatively with a variety of different embodiments of transom bracket assemblies.

Figure 1:
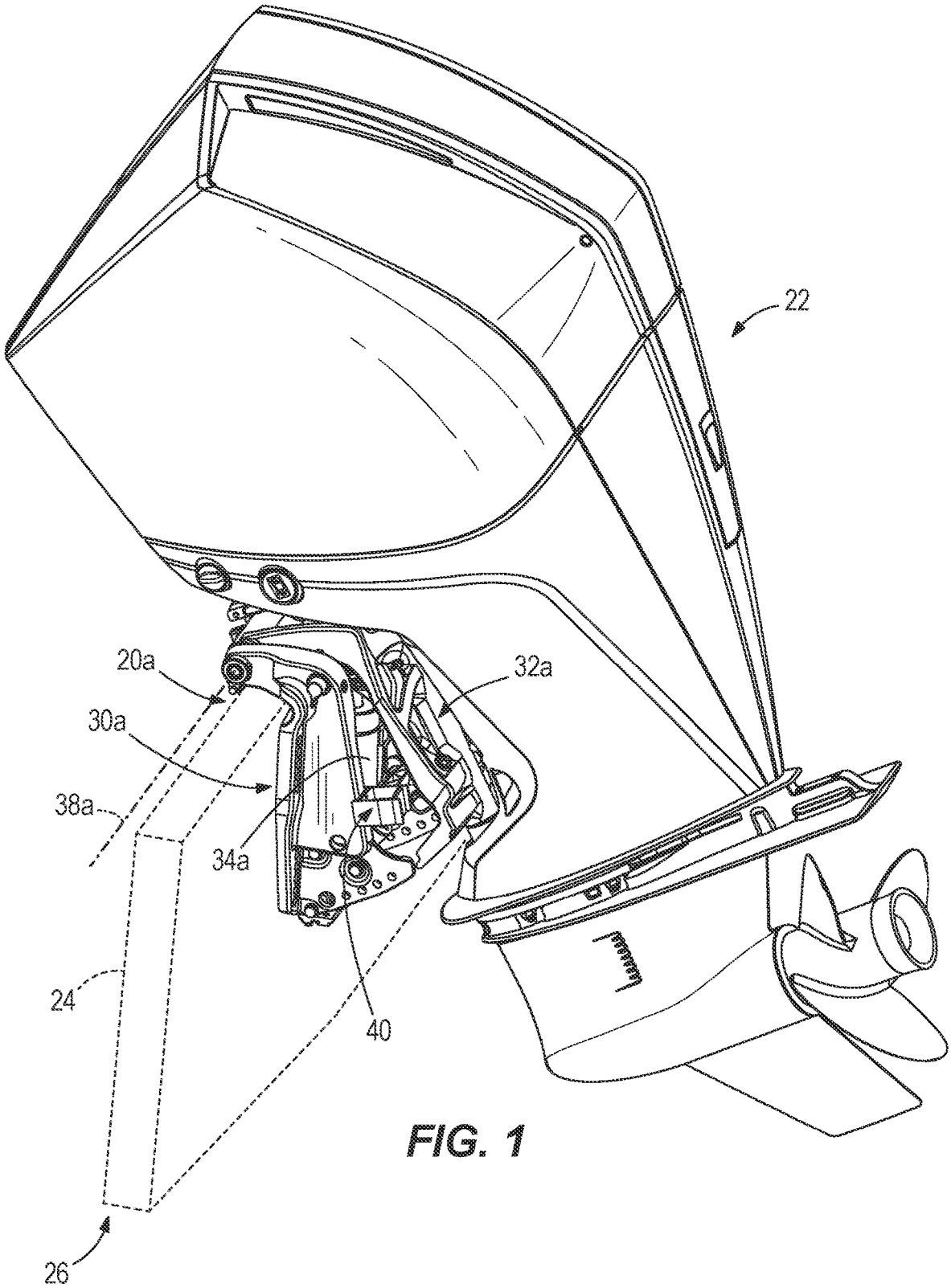
FIG. 1 is a port-side perspective view looking down at an outboard motor supported in a trim position relative to a marine vessel by a first embodiment of a transom bracket assembly and a transom saver according to the present disclosure.

FIG. 1 depicts a first embodiment of a transom bracket assembly 20*a* for supporting an outboard motor 22 in a trim position relative to the transom 24 of a marine vessel 26. The transom bracket assembly 20*a* includes a transom bracket 30*a* that is fixed to the transom 24 of the marine vessel 26 in a conventional manner and a swivel bracket 32*a* that is fixed to the outboard motor 22, for example to a supporting cradle of the outboard motor 22 as disclosed in the presently incorporated U.S. Pat. No. 10,981,637. A conventional hydraulic actuator 34*a* is configured to extend and retract under pressure from a hydraulic pump so as to pivot the swivel bracket 32*a* up and down relative to the transom bracket 30*a* about a trim axis 38*a*. Reference is made to the above-incorporated U.S. Pat. No. 10,981,637, which in detail discloses the transom bracket assembly 20*a*, including the hydraulic actuator 34*a*, and the manner in which the hydraulic actuator 34*a* is configured to pivot the swivel bracket 32*a* up and down about the trim axis 38*a*. As will become more apparent from the following description, the presently disclosed transom saver embodiments are specially configured for use with the transom bracket assembly 20*a* shown in FIG. 1 as well as for use with other, different transom bracket assemblies, for example the second and third embodiments thereof 20*b*, 20*c* shown in FIGS. 8-11.

Figure 2:
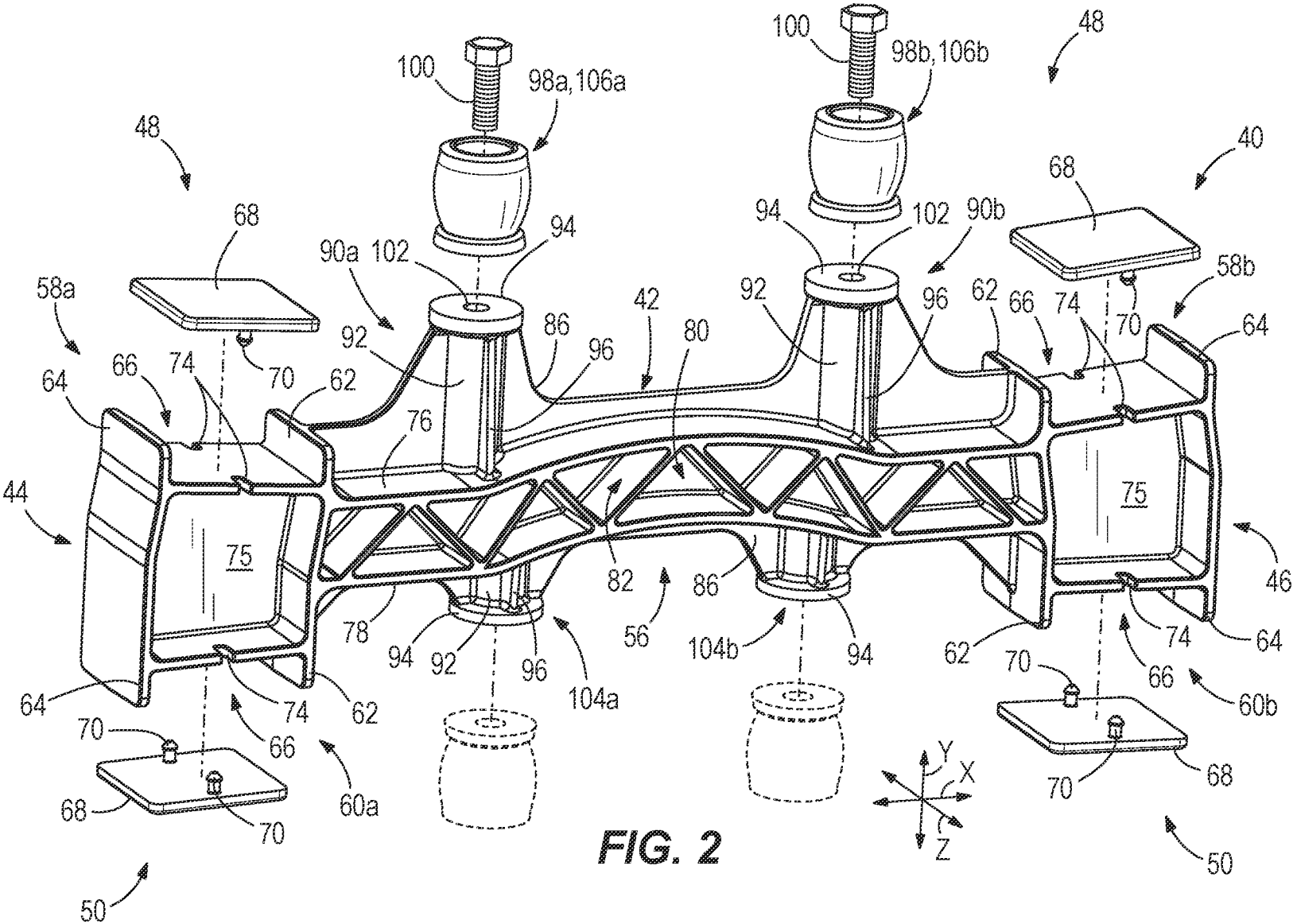
FIG. 2 is an exploded view of the transom saver.
Figure 3:
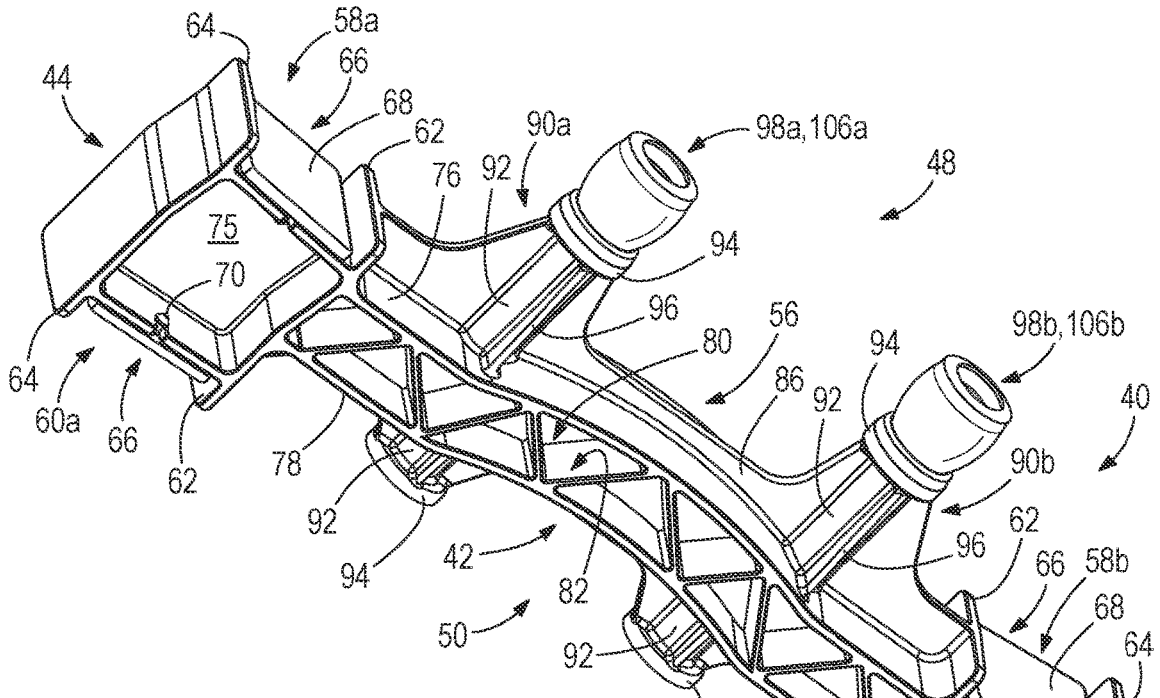
FIG. 3 is a view of the transom saver configured for use with the first embodiment of the transom bracket assembly.
Figure 4:
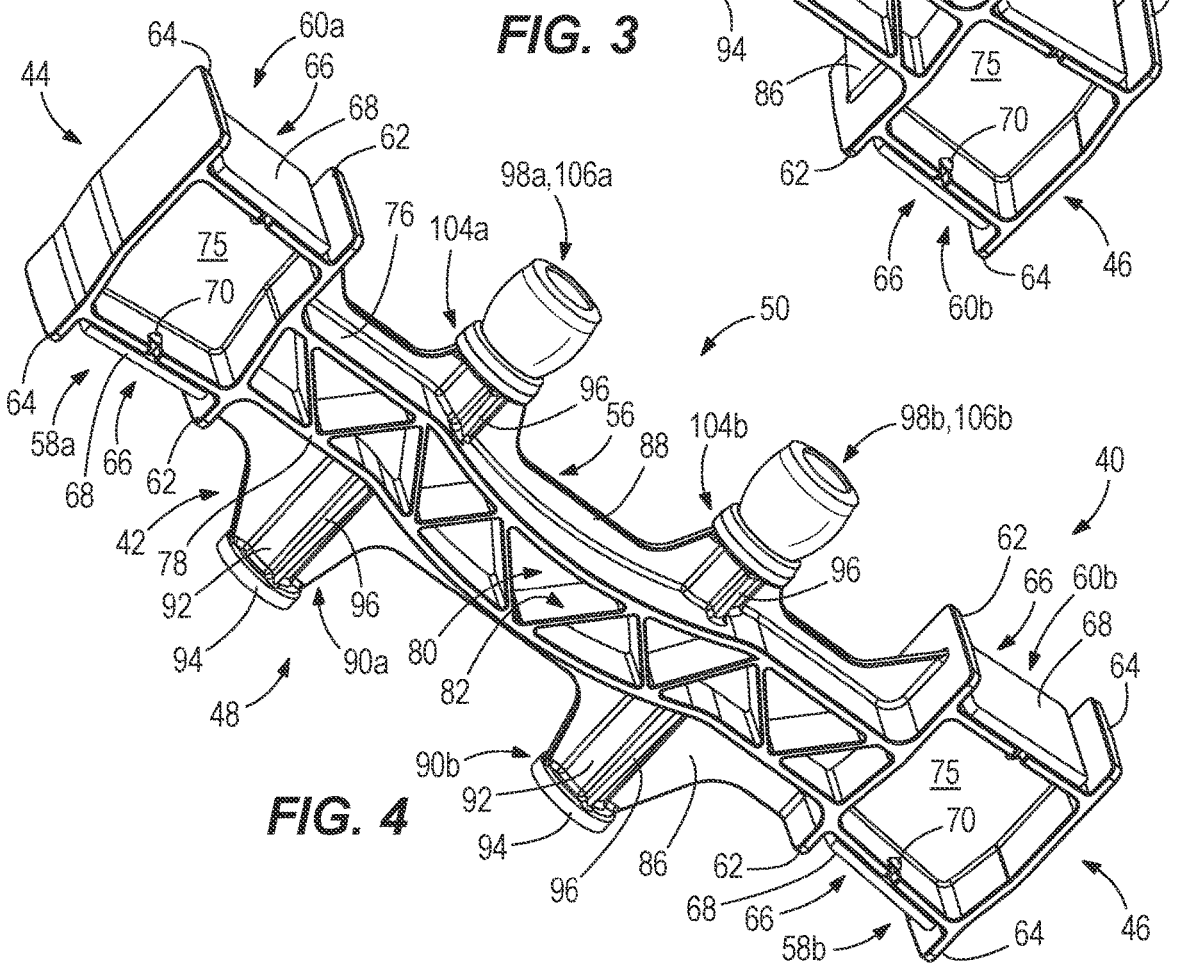
FIG. 4 is a view of the transom saver configured for use with second and third embodiments of the transom bracket assembly.

FIGS. 2-4 depict a novel transom saver 40 according to the present disclosure. The transom saver 40 has a body 42 that extends between a first end 44 and an opposite second end 46 in a width direction X, between a first side 48 and an opposite second side 50 in a height direction Y that is perpendicular to the width direction X, and between a front side (shown in FIGS. 2-4) and a back side (not shown in FIGS. 2-4, but being identical to the front side) in a depth direction Z that is perpendicular to the width direction X and perpendicular to the height direction Y.

The body 42 has a central frame portion 56, opposing seats 58*a*, 58*b* that are spaced apart along the first side 48, on opposite sides of the central frame portion 56, and opposing seats 60*a*, 60*b* that are spaced apart along the second side 50, on the opposite side of the central frame portion 56. Each of the seats 58*a*, 58*b* and the seats 60*a*, 60*b* have inner and outer sidewalls 62, 64 that protrude from the respective first and second side 48, 50 of the body 42 and together define a channel 66 therebetween for receiving a transom bracket assembly 20*a*, 20*b*, 20*c* in a seated position, as will be further described herein below with reference to FIGS. 5-11. Optionally, resilient pads 68 are coupled to the body 42 in the channel 60. The resilient pads 68 are made of a thin strip of rubber or any other suitable resilient material that does not scratch the surfaces with which it contacts. The manner of coupling the resilient pads 68 to the body 42 can vary from what is shown. In the illustrated embodiment, the resilient pads 68 have a pair of locking protrusions 70 with enlarged cone-shaped arrow heads sized large enough to engage with slots 74 formed in the front and back sides 52, 54 of the body 42 along the channel 60. As shown, the inner and outer sidewalls 62, 64 extend all the way from and between the respective opposing seats 58*a*, 58*b* and seats 60*a*, 60*b*. In the space between the opposing seats 58*a*, 58*b* and seats 60*a*, 60*b*, the body 42 has generally square-shaped recesses 75, i.e. on both the front side and back side, which provide reduced weight and material savings. As such, referring to FIGS. 2-4, the transom saver 40 has generally equally portioned opposing seats 58*a*, 58*b* and seats 60*a*, 60*b*, each having resilient surfaces for safely engaging and supporting surfaces of the transom bracket assembly 20*a* without scratching or damaging those surfaces, as will be further described herein below.

Referring to FIGS. 2-4, the central frame portion 56 is generally elongated in the width direction X, having walls 76, 78 that extend between the opposing seats 58*a*, 58*b*, 60*a*, 60*b* in the width direction X and a back wall 80 that connects the end walls 76, 78 in the height direction Y. A first series of angular ribs 82 extend between the end walls 76, 78 and outwardly from the back wall 80 on the front side 52 of the body 42. The angular ribs 82, back wall 80, and end walls 76, 78 together define a series of triangular-shaped recesses. A corresponding second series of angular ribs (not shown) extends between the end walls 76, 78 and outwardly from the back wall 80 on the back side 54 of the body 42 and together with the end walls 76, 78 and back wall 80 define a series of triangular shaped recesses. Generally, the angular ribs 82, 84 provide a trusswork that strengthens the body 42 under load conditions and the triangular-shaped recesses provide material and weight savings.

The central frame portion 56 has a strengthening rib 86 that outwardly protrudes from the center of the end wall 76 on the first side 48 of the body 42, between the opposing seats 58*a*, 58*b*. The central frame portion 56 also has an opposing strengthening rib 88 that outwardly protrudes from the center of the end wall 78 on the second side 50 of the body 42, between the opposing seats 60*a*, 60*b*. The strengthening ribs 86, 88 provide the body 42 with additional strength and rigidity under load conditions.

A first pair of pedestals 90*a*, 90*b* is spaced apart in the width direction X and protrudes from the first side 48 of the body 42 along the central frame portion 56, between the seats 58*a*, 58*b*. Each pedestal 90 in the pair has a top flange 94 and a cylindrical center column 92 which extends from the end wall 76 to the top flange 94. A pair of radially opposed strengthening ribs 96 radially extend from the center column 92 and together with the strengthening rib 86 provide strength and rigidity to the pedestal 90 under loading conditions. A pair of springs 98*a*, 98*b* is removably coupled to the pair of pedestals 90*a*, 90*b*. The type and configuration of spring can vary from what is shown. In the illustrated example, each spring 98*a*, 98 is a high-load fastener-mount compression spring made of a blend of polyester and rubber, which for example is commercially available for purchase from McMaster-Carr. Each spring 98*a*, 98*b* has a barrel-shaped body and end flange that is removably attached to the top end of the pedestal 90*a*, 90*b* via a threaded fastener 100 engaged with a bore 102 in the center of the top flange 94.

A second pair of pedestals 104*a*, 104*b* is spaced apart in the width direction X and protrudes from the second side 50 of the body 42 along the central frame portion 56, between the seats 60*a*, 60*b*. The spacing between the second pair of pedestals 104*a*, 104*b* is smaller than the spacing between the first pair of pedestals 90*a*, 90*b*. Similar to the first pair of pedestals 90*a*, 90*b*, each pedestal 104 has a top flange 94 and a cylindrical center column 92 that extends from the end wall 78 to the top flange 94. A pair of radially opposed strengthening ribs 96 radially extend from the center column 92 and together with the strengthening rib 88 provide strength and rigidity to the pedestal 104 under loading conditions. A pair of springs 106*a*, 106*b* is coupled to the pair of pedestals 104*a*, 104*b*. In certain examples, the pair of springs 106*a*, 106*b* are the very same springs described herein above with reference to 98*a*, 98*b*. For this reason, the pair of springs 106*a*, 106*b* are shown in phantom line in FIG. 2. In other words, in use, as further described herein below, the springs 98*a*, 98*b* can be removed from the pedestals 90*a*, 90*b* by unthreading the fastener 100 from the bore 102 and then installed as the springs 106*a*, 106*b* on the pedestals 104*a*, 104*b*. Thus, in the illustrated example, like the springs 98*a*, 98*b*, the springs 106*a*, 106*b* also have a barrel-shaped body and end flange that is removably attached to the top end of the pedestal 104*a*, 104*b* via a threaded fastener 100 engaged with a bore 102 in the center of the top flange 94.

Figure 5:
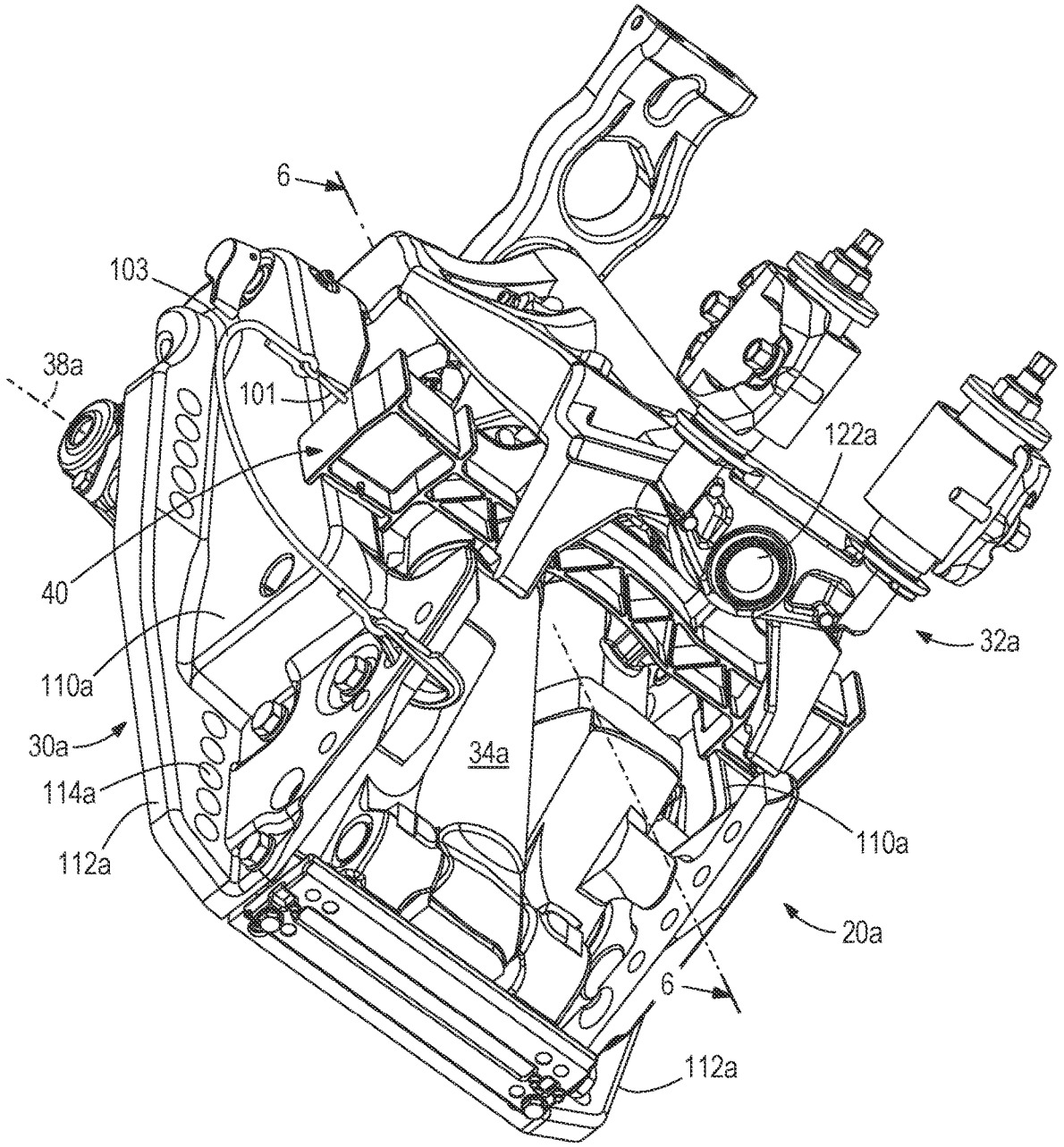
FIG. 5 is a port-side perspective view looking up at the transom saver in position of use relative to the first embodiment of the transom bracket assembly comprising a first transom bracket for being fixed to the marine vessel and a first swivel bracket for being fixed to the outboard motor.

Referring to FIG. 5 a hole 101 can be formed in the body 42 for attaching a safety lanyard 103 for attaching the transom saver 40 to the transom bracket assembly or outboard motor to prevent loss of the transom saver 40 during transport, for example should it accidentally dislodge from its position of use.

Figure 6:
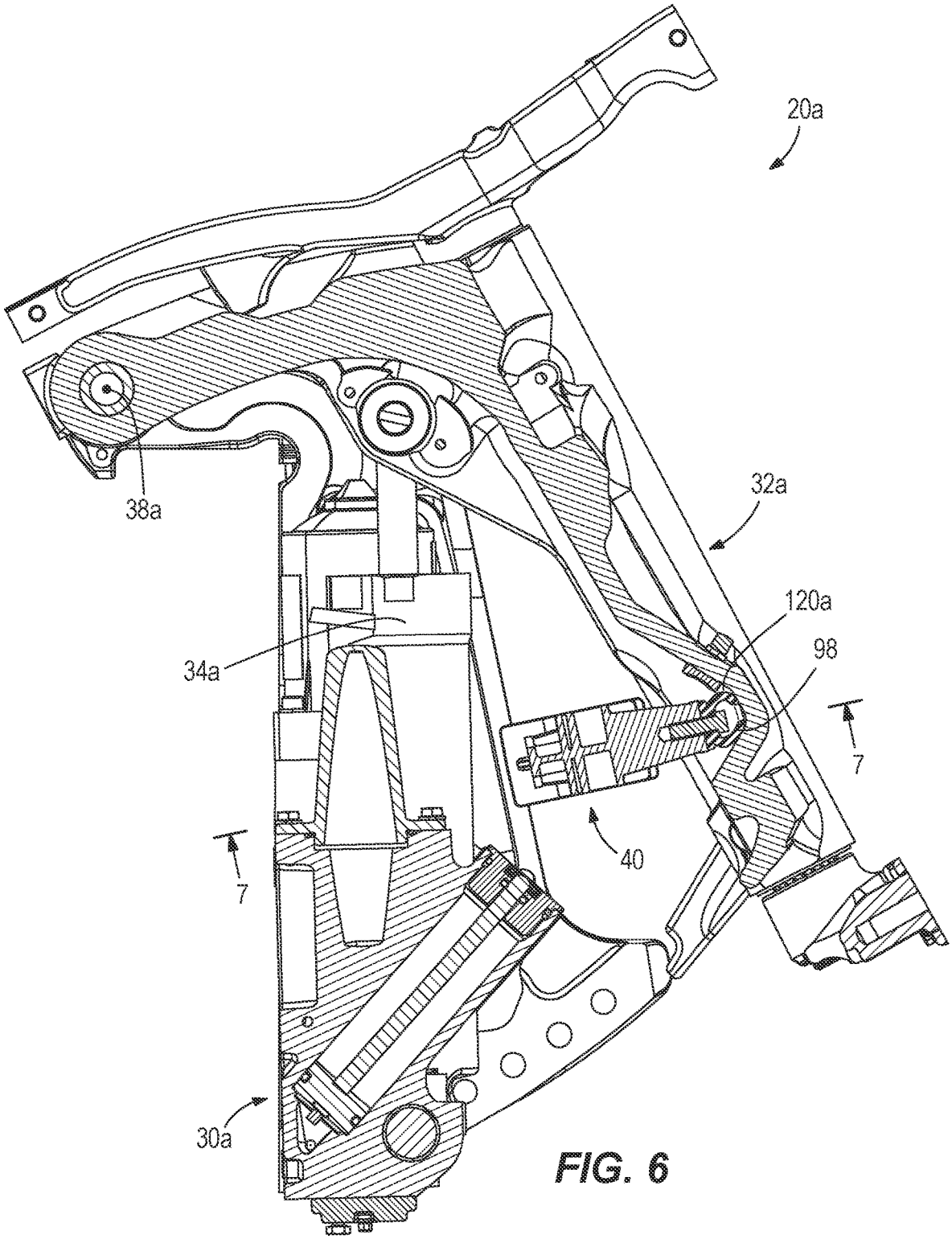
FIG. 6 is a view of section 6-6, taken in FIG. 5.
Figure 7:
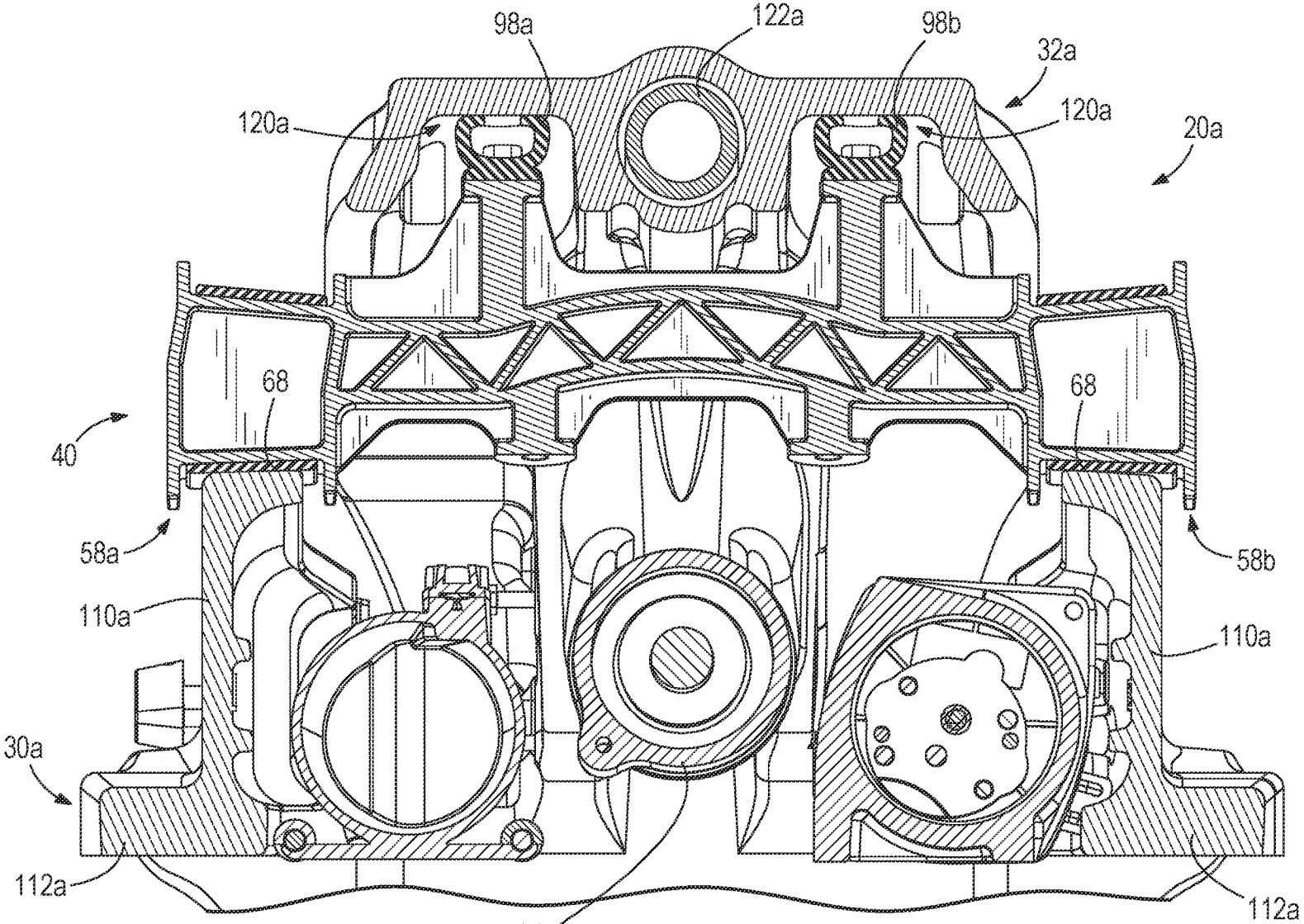
FIG. 7 is a view of section 7-7, taken in FIG. 6.

FIGS. 5-7 depict the transom saver 40 in a first position of use in conjunction with the first embodiment of the transom bracket assembly 20*a* shown in FIG. 1. In this position, the transom saver 40 is wedged between middle portions of the transom bracket 30*a* and swivel bracket 32*a* such that the first side 48 of the transom saver 40 faces and abuts the transom bracket 30*a*. In particular, the transom bracket 30*a* has port and starboard bracket arms 110*a* that generally extend along the surface of the transom 24. End flanges 112*a* laterally outwardly extend from the port and starboard bracket arms 110*a* along the surface of the transom 24 and have holes 114*a* through which fasteners (not shown) are inserted to fasten the transom bracket 30*a* to the transom 24. As best shown in FIG. 7, the spacing between the seats 58*a*, 58*b*, and particularly between the channels 66 thereof, corresponds to the spacing between the port and starboard bracket arms 110*a*. The width of the channels 66 is slightly larger than the width of the port and starboard bracket arms 110*a* such that in the position of use shown in FIGS. 5-7, the channels 66 receive the port and starboard bracket arms 110*a* and resilient pads 68 abut the outer surfaces of the port and starboard bracket arms 110*a* without scratching or causing any other damage to the transom bracket 30*a*.

The opposite second side 50 of the transom saver 40 faces and abuts the swivel bracket 32*a*. In particular, the swivel bracket 32*a* has indented port and starboard surfaces 120*a* on opposite sides of a swivel tube 122, which is for steering of the outboard motor 22 as described in the above-incorporated U.S. Pat. No. 10,981,637. As best shown in FIG. 7, the spacing between the pair of pedestals 90*a*, 90*b* corresponds to the spacing between the port and starboard surfaces 120*a*. In the position of use shown in FIGS. 5-7, the pair of springs 98*a*, 98*b* abut the swivel bracket 32*a* along the indented port and starboard surfaces 120*a* such that the transom saver 40 resiliently supports the swivel bracket 32*a* and associated outboard motor 22 in the trim position shown without scratching or otherwise damaging the transom bracket assembly 20*a*, including the transom bracket 30*a* and swivel bracket 32*a* thereof. The outer contours of the transom saver 40 are advantageously configured so as to avoid engagement with components of the transom bracket assembly 20*a* other than the resilient and scratch-free engagements noted above. For example, the second side 50 of the body 42 along the central frame portion 56, between the 60*a*, 60*b*, has a concave shape (sec FIG. 7) configured to avoid engagement with the hydraulic actuator 34*a* on the transom bracket 30*a*.

Figure 8:
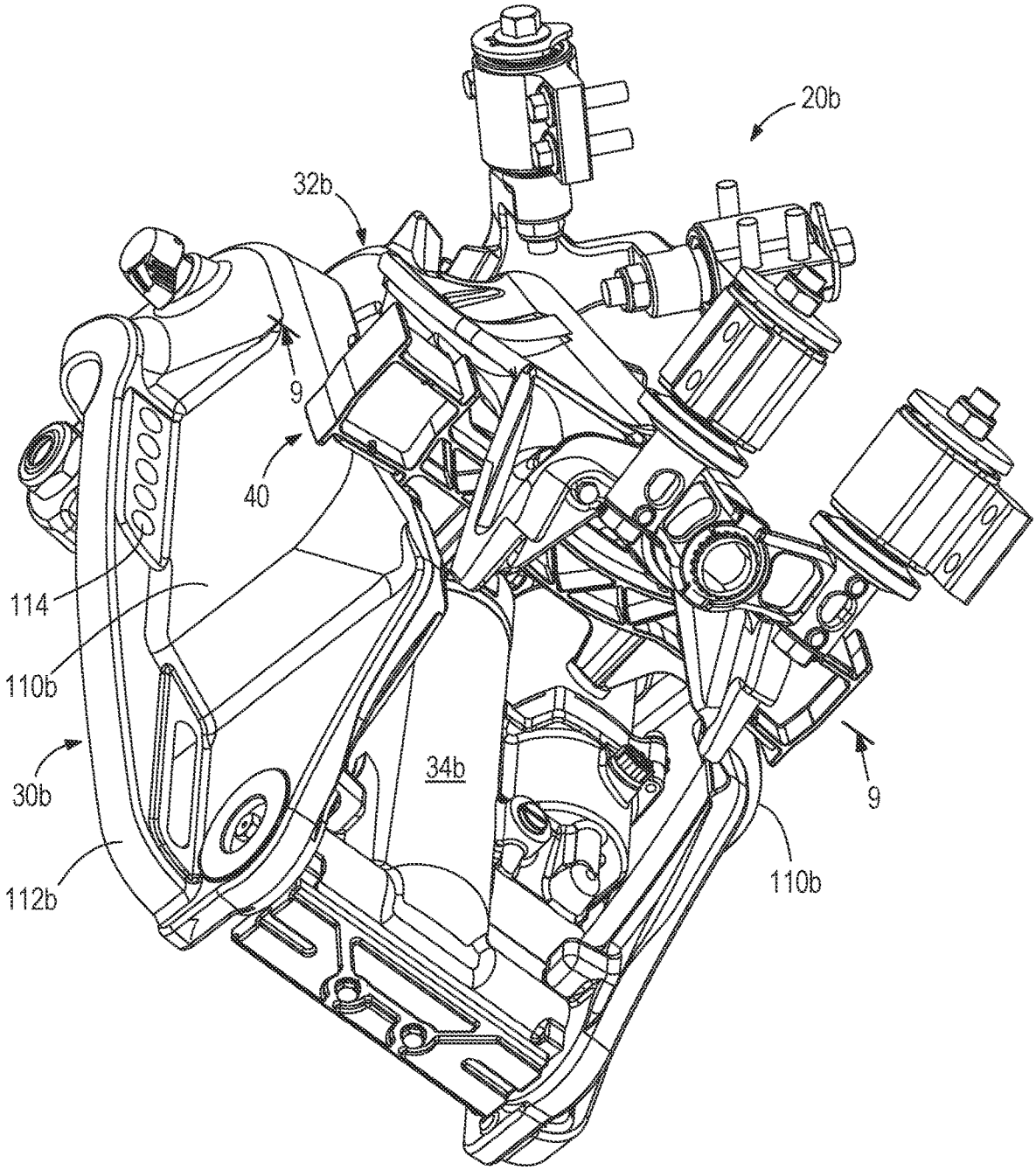
FIG. 8 is a port-side perspective view looking up at the transom saver in position of use relative to the second embodiment of the transom bracket assembly comprising a second transom bracket for being fixed to the marine vessel and a second swivel bracket for being fixed to the outboard motor.
Figure 9:
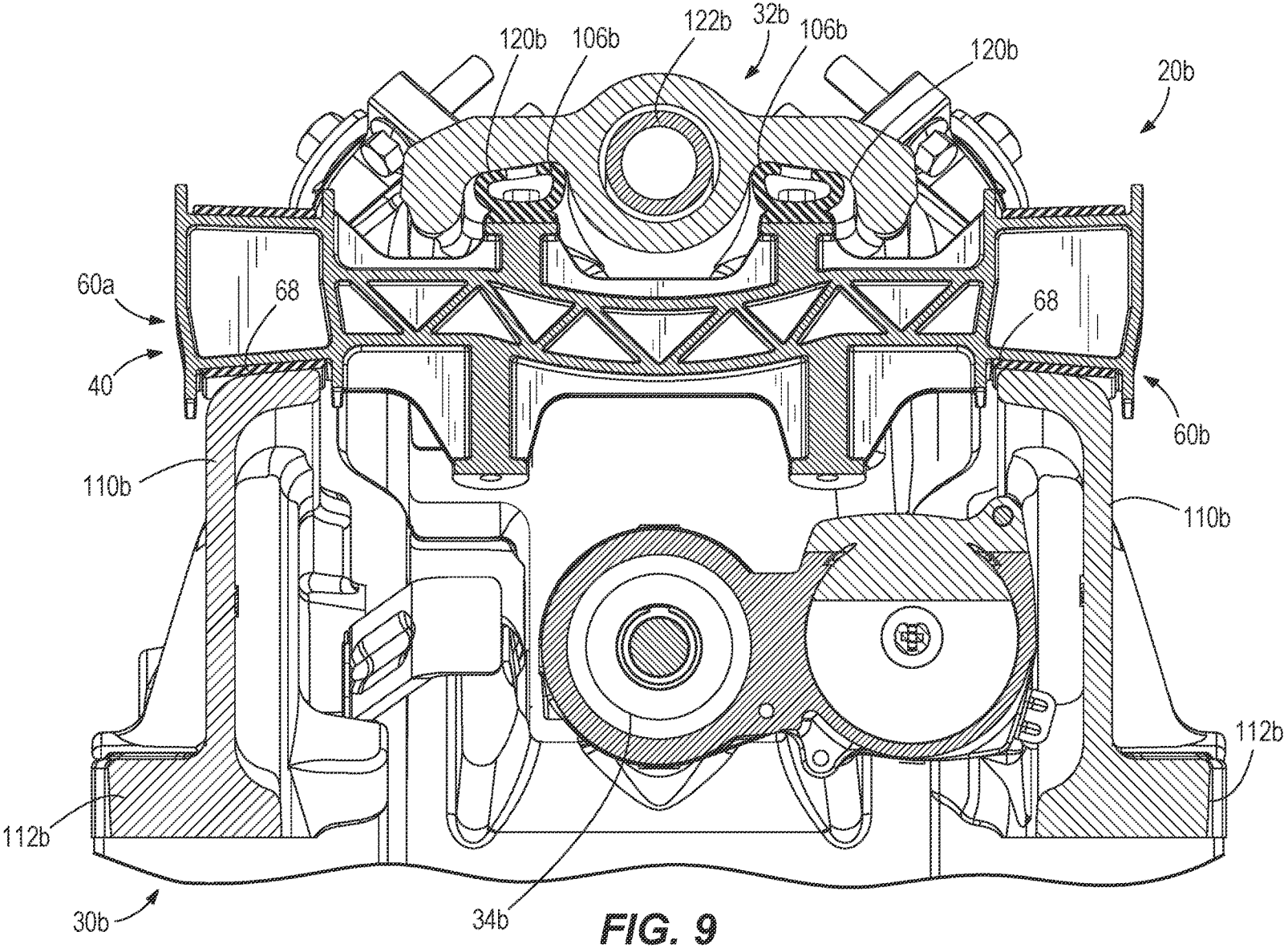
FIG. 9 is a view of section 9-9, taken in FIG. 8.

FIGS. 8-9 depict the transom saver 40 in a second position of use in conjunction with a second embodiment of the transom bracket assembly 20*b*. In this position, the transom saver 40 is wedged between middle portions of a transom bracket 30*b* and swivel bracket 32*b* of the second embodiment of the transom bracket assembly 20*b*, such that the second side 50 of the transom saver 40 faces and abuts the transom bracket 30*b*. Note that this is the opposite orientation compared to the first position of use described herein above with respect to FIGS. 5-7. In use, prior to installation in the position shown, the springs 98*a*, 98*b* are removed from the pedestals 90*a*, 90*b* and installed onto the pedestals 104*a*, 104*b*, as springs 106*a*, 106*b*, as described herein above.

As shown in FIGS. 8-9, the transom bracket 30*b* has port and starboard bracket arms 110*b* that generally extend along the surface of the transom 24. End flanges 112*b* laterally outwardly extend from the port and starboard bracket arms 110*b* along the surface of the transom 24 and have holes 114*b* through which fasteners (not shown) are inserted to fasten the transom bracket 30*b* to the transom 24. As best shown in FIG. 9, the spacing between the seats 60*a*, 60*b*, and particularly between the channels 66 thereof, corresponds to the spacing between the port and starboard bracket arms 110*b*. The width of the channels 66 is slightly larger than the width of the port and starboard bracket arms 110*b* such that in the position of use shown in FIGS. 8-9, the channels 66 receive the port and starboard bracket arms 110*b* and resilient pads 68 abut the outer surfaces of the port and starboard bracket arms 110*b* without scratching or causing any other damage to the transom bracket 30*b*.

The opposite second side 50 of the transom saver 40 faces and abuts the swivel bracket 32*b*. In particular, the swivel bracket 32*b* has indented port and starboard surfaces 120*b* on opposite sides of a swivel tube 122*b*, which is for steering of the outboard motor 22 as described in the above-incorporated U.S. Pat. No. 10,981,637. As best shown in FIG. 7, the spacing between the pair of pedestals 90*a*, 90*b* corresponds to the spacing between the port and starboard surfaces 120*b*, 120*b*. In the position of use shown in FIGS. 8-9, the pair of springs 106*a*, 106*b* abut the swivel bracket 32*b* along the indented port and starboard surfaces 120*b* such that the transom saver 40 resiliently supports the swivel bracket 32 and associated outboard motor 22 in the trim position shown without scratching or otherwise damaging the transom bracket assembly 20*b*, including the transom bracket 30*b* and swivel bracket 32*b* thereof. The outer contours of the transom saver 40 are advantageously configured so as to avoid engagement with components of the transom bracket assembly 20*b* other than the resilient and scratch-free engagements noted above.

Figure 10:
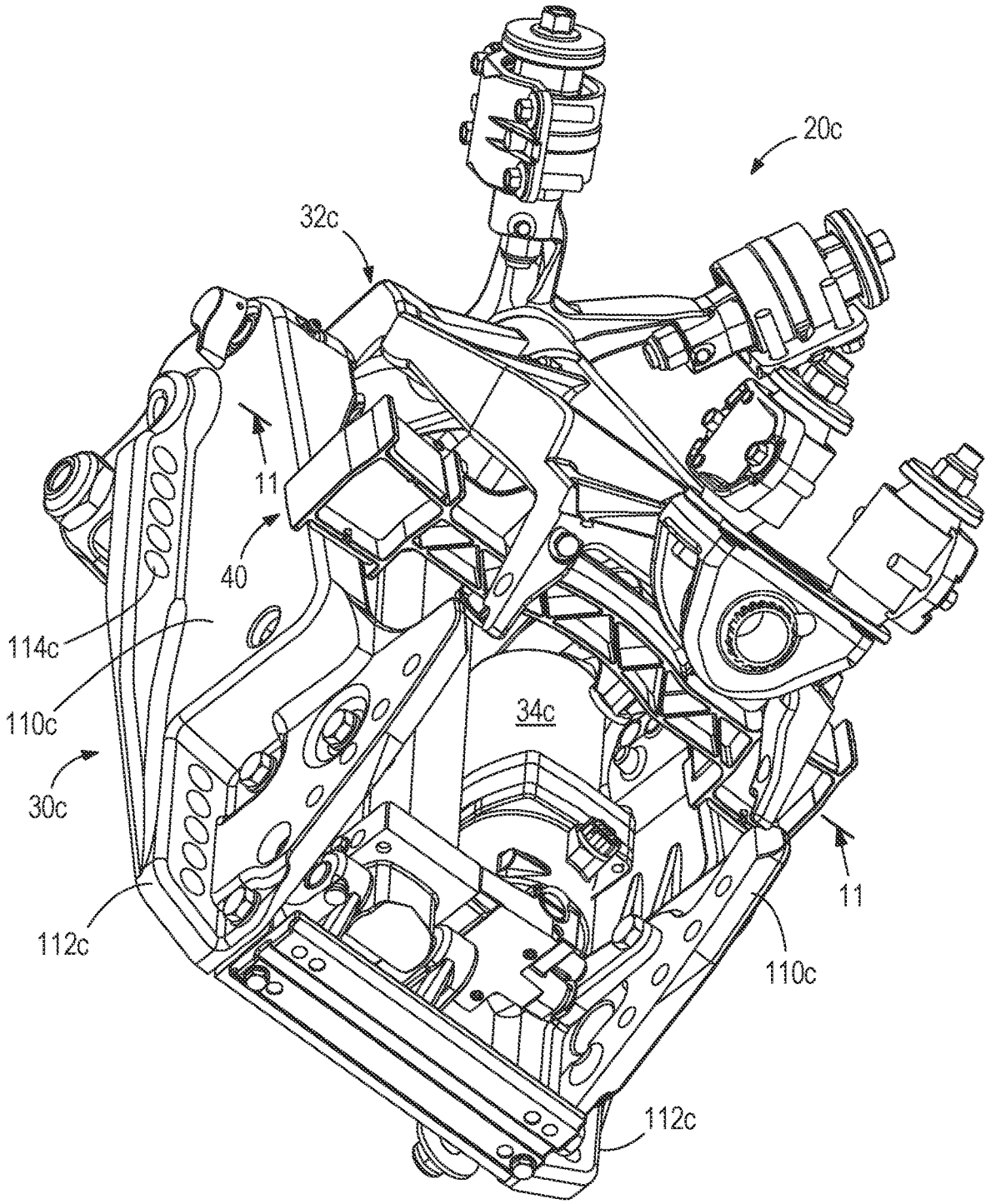
FIG. 10 is a port-side perspective view looking up at the transom saver in position of use relative to a third embodiment of the transom bracket assembly comprising a third transom bracket for being fixed to the marine vessel and a third swivel bracket for being fixed to the outboard motor.
Figure 11:
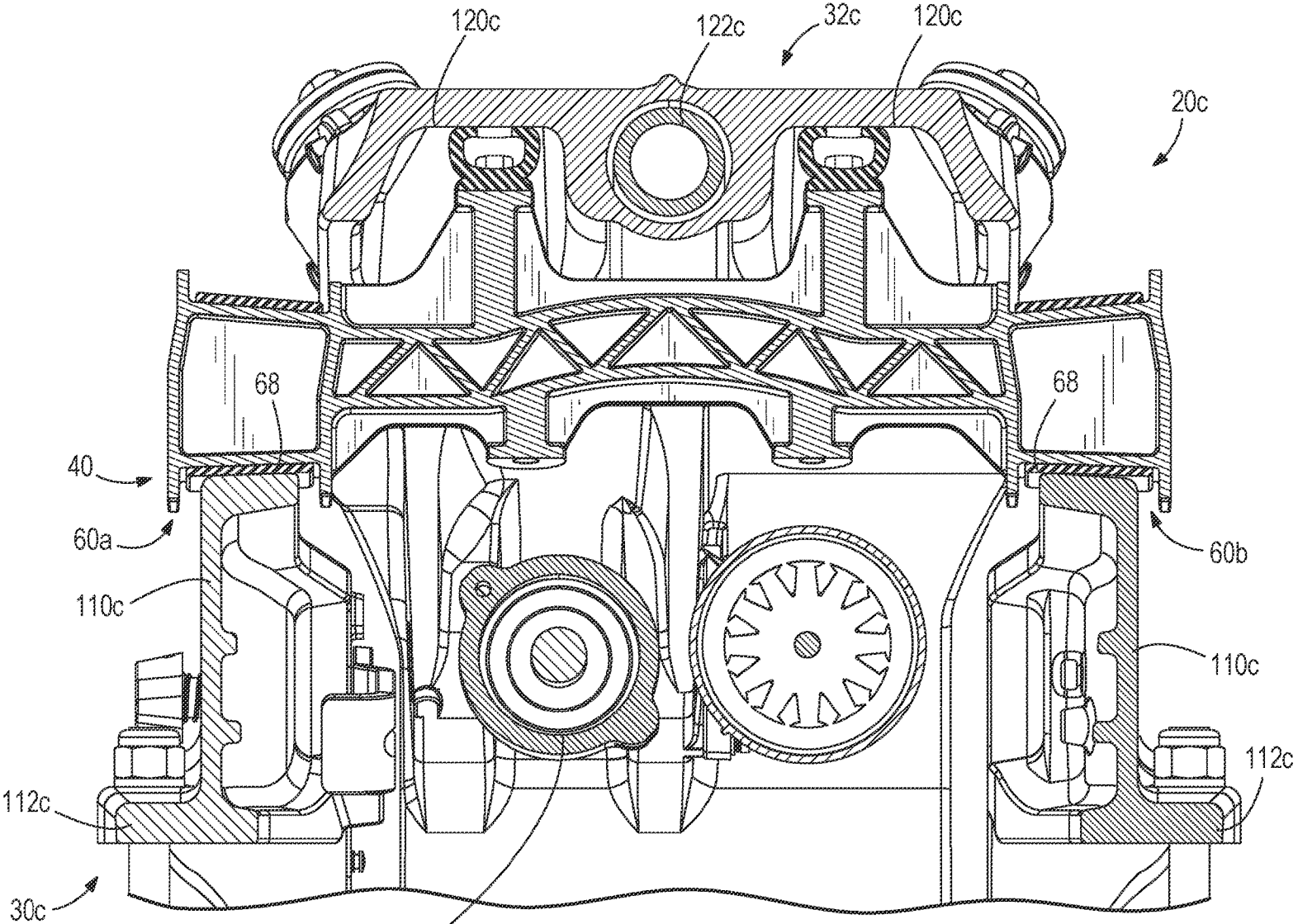
FIG. 11 is a view of section 11-11, taken in FIG. 10.

FIGS. 10-11 depict the transom saver 40 in the same (second) position of use shown in FIGS. 8-9, however it is shown in conjunction with a third embodiment of the transom bracket assembly 20*c*. In this position, the transom saver 40 is wedged between middle portions of a transom bracket 30*c* and swivel bracket 32*c* of the second embodiment of the transom bracket assembly 20*c*, such that the second side 50 of the transom saver 40 faces and abuts the transom bracket 30*c*. Note that this is the same orientation compared to the second position of use described herein above with respect to FIGS. 8-9. In particular, the transom bracket 30*c* has port and starboard bracket arms 110*c* that generally extend along the surface of the transom 24. End flanges 112*c* laterally outwardly extend from the port and starboard bracket arms 110*c* along the surface of the transom 24 and have holes 114*c* through which fasteners (not shown) are inserted to fasten the transom bracket 30*b* to the transom 24. As best shown in FIG. 11, the spacing between the seats 60*a*, 60*b*, and particularly between the channels 66 thereof, corresponds to the spacing between the port and starboard bracket arms 110*c*. The width of the channels 66 is slightly larger than the width of the port and starboard bracket arms 110*c* such that in the position of use shown in FIGS. 8-9, the channels 66 receive the port and starboard bracket arms 110*c* and resilient pads 68 abut the outer surfaces of the port and starboard bracket arms 110*c* without scratching or causing any other damage to the transom bracket 30*b*.

The opposite second side 50 of the transom saver 40 faces and abuts the swivel bracket 32*c*. In particular, the swivel bracket 32*c* has indented port and starboard surfaces 120*c* on opposite sides of a swivel tube 122*c*, which is for steering of the outboard motor 22 as described in the above-incorporated U.S. Pat. No. 10,981,637. As best shown in FIG. 11, the spacing between the pair of pair of pedestals 90*a*, 90*b* corresponds to the spacing between the port and starboard surfaces 120*c*. In the position of use shown in FIGS. 10-11, the pair of springs 106*a*, 106*b* abut the swivel bracket 32*c* along the indented port and starboard surfaces 120*c* such that the transom saver 40 resiliently supports the swivel bracket 32 and associated outboard motor 22 in the trim position shown without scratching or otherwise damaging the transom bracket assembly 20*c*. The outer contours of the transom saver 40 are advantageously configured so as to avoid engagement with components of the transom bracket assembly 20*c* other than the resilient and scratch-free engagements noted above.

It will thus be recognized that the present disclosure provides embodiments of a transom saver for supporting an outboard motor in a trim position relative to a marine vessel. The outboard motor is pivotably coupled to the marine vessel by (A) a first transom bracket assembly comprising a first transom bracket fixed to the marine vessel and a first swivel bracket fixed to the outboard motor and being pivotable relative to the transom bracket, and alternately (B) a second transom bracket assembly comprising a second transom bracket fixed to the marine vessel and a second swivel bracket fixed to the outboard motor and being pivotable relative to the transom bracket. The transom saver is advantageously configured for use with both the first transom bracket assembly and the second transom bracket assembly. The transom saver has a body that extends between a first end and a second end in a width direction, between a first side and a second side in a height direction that is perpendicular to the width direction, and between a front side and a back side in a depth direction that is perpendicular to the width direction and perpendicular to the height direction. The body has a first seat and a second seat, the first seat and second seat being spaced apart along the first side in the width direction and being configured to support the first transom bracket in a first position of use, and wherein a first spring is disposed on the second side and is configured to resiliently support the first swivel bracket in the first position of use. The body further has a third seat and a fourth seat, the third seat and fourth seat being spaced apart along the second side in the width direction and being configured to support the second transom bracket in a second position of use, and a second spring disposed on the first side and being configured to resiliently support the second swivel bracket in the second position of use.

This written description uses examples to disclose the invention, including the best mode, and to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A transom saver for supporting an outboard motor in a trim position relative to a marine vessel, the outboard motor being pivotably coupled to the marine vessel by a transom bracket assembly comprising a transom bracket fixed to the marine vessel and a swivel bracket fixed to the outboard motor and being pivotable relative to the transom bracket, the transom saver comprising:

a body that extends between a first end and a second end in a width direction, between a first side and a second side in a height direction that is perpendicular to the width direction, and between a front side and a back side in a depth direction that is perpendicular to the width direction and perpendicular to the height direction, wherein the body comprises a first seat and a second seat, the first seat and second seat being spaced apart along the first side in the width direction and being configured to support the transom bracket in a position of use; and at least one spring disposed on the second side and being configured to resiliently support the swivel bracket in the position of use.

2. The transom saver according to claim 1, further comprising a pedestal that supports the at least one spring with respect to the body.

3. The transom saver according to claim 1, wherein the at least one spring is one of a pair of springs that are spaced apart along the second side and are located between the first seat and the second seat in the width direction.

4. The transom saver according to claim 3, further comprising a pair of pedestals supporting the pair of springs with respect to the body, the pair of pedestals being located between the first seat and the second seat in the width direction.

5. The transom saver according to claim 1, wherein the first seat and the second seat each have inner and outer sidewalls that define a channel for receiving the transom bracket in a seated position.

6. The transom saver according to claim 5, further comprising a resilient pad located in the channel for resiliently abutting the transom bracket when the transom bracket is in the seated position.

7. The transom saver according to claim 1, further comprising a strengthening rib that centrally extends along the first side from the first seat to the second seat.

8. The transom saver according to claim 1, further comprising a first plurality of angular ribs extending along the front side from the first seat to the second seat and a second plurality of angular ribs extending along the back side from the first seat to the second seat.

9. The transom saver according to claim 1, being further configured for alternate use with a different second transom bracket assembly for pivotably coupling the outboard motor to the marine vessel, wherein the body comprises first and second seats on the second side, and further comprising at least one spring disposed on the first side.

10. The transom saver according to claim 9, wherein the at least one spring disposed on the first side is one of a pair of springs that are spaced apart along the first side and are located between the first seat and the second seat on the first side in the width direction.

11. A transom saver for supporting an outboard motor in a trim position relative to a marine vessel, the outboard motor being pivotably coupled to the marine vessel by (A) a first transom bracket assembly comprising a first transom bracket fixed to the marine vessel and a first swivel bracket fixed to the outboard motor and being pivotable relative to the first transom bracket, and alternately (B) a second transom bracket assembly comprising a second transom bracket fixed to the marine vessel and a second swivel bracket fixed to the outboard motor and being pivotable relative to the second transom bracket, the transom saver being configured for use with both the first transom bracket assembly and the second transom bracket assembly, the transom saver comprising:

a body that extends between a first end and a second end in a width direction, between a first side and a second side in a height direction that is perpendicular to the width direction, and between a front side and a back side in a depth direction that is perpendicular to the width direction and perpendicular to the height direction, wherein the body comprises a first seat and a second seat, the first seat and second seat being spaced apart along the first side in the width direction and being configured to support the first transom bracket in a first position of use, and wherein a first spring is disposed on the second side and is configured to resiliently support the first swivel bracket in the first position of use, and wherein the body further comprises a third seat and a fourth seat, the third seat and the fourth seat being spaced apart along the second side in the width direction and being configured to support the second transom bracket in a second position of use, and a second spring disposed on the first side and being configured to resiliently support the second swivel bracket in the second position of use.

12. The transom saver according to claim 11, further comprising a first pedestal that supports the first spring with respect to the body and a second pedestal that supports the second spring with respect to the body.

13. The transom saver according to claim 11, wherein the first spring is one of a pair of first springs that are spaced apart along the second side and are located between the third seat and the fourth seat in the width direction, and further wherein the second spring is one of a pair of second springs that are spaced apart along the first side and are located between the first seat and the second seat in the width direction.

14. The transom saver according to claim 13, further comprising a first pair of pedestals supporting the first pair of springs with respect to the body, and a second pair of pedestals supporting the second pair of springs with respect to the body.

15. The transom saver according to claim 14, wherein the first seat and the second seat each have inner and outer sidewalls that define first channels for receiving the first transom bracket in a seated position, and wherein the third seat and the fourth seat each have inner and outer sidewalls that define second channels for receiving the second transom bracket in a seated position.

16. The transom saver according to claim 15, further comprising first resilient pads located in the first channels for resiliently abutting the first transom bracket when the first transom bracket is in the seated position and further comprising second resilient pads located in the second channels for resiliently abutting the second transom bracket when the second transom bracket is in the seated position.

17. The transom saver according to claim 11, further comprising a first strengthening rib that centrally extends along the first side from the first seat to the second seat and a second strengthening rib that centrally extends along the second side from the third seat to the fourth seat.

18. The transom saver according to claim 11 further comprising a first plurality of angular ribs extending along the front side from the first seat to the second seat and from the third seat to the fourth seat, a second plurality of angular ribs extending along the back side from the first seat to the second seat and from the third seat to the fourth seat.

19. The transom saver according to claim 11, wherein the first spring disposed on the second side is one of a pair of first springs that are spaced apart along the second side and are located between the first seat and the second seat on the first side in the width direction, and wherein the second spring disposed on the second side is one of a pair of second springs that are spaced apart along the second side and are located between the third seat and the fourth seat on the second side in the width direction.

20. The transom saver according to claim 19, wherein the first springs are spaced further apart from each other than the second springs are spaced apart from each other.

* * * * *